US008919069B2

(12) United States Patent
Bird et al.

(10) Patent No.: US 8,919,069 B2
(45) Date of Patent: Dec. 30, 2014

(54) SYSTEMS AND METHODS FOR SELECTIVELY RELEASABLE MODULAR TILE

(71) Applicant: Sof'Solutions, Inc., Draper, UT (US)

(72) Inventors: Elouise R. Bird, Draper, UT (US); Morgan Miller, Orem, UT (US); Scott Barker, Draper, UT (US)

(73) Assignee: Sof'Solutions, Inc., Draper, UT (US)

( * ) Notice: Subject to any disclaimer, the term of this patent is extended or adjusted under 35 U.S.C. 154(b) by 0 days.

(21) Appl. No.: 13/869,566

(22) Filed: Apr. 24, 2013

(65) Prior Publication Data

US 2014/0318071 A1 Oct. 30, 2014

(51) Int. Cl.
*E04F 15/00* (2006.01)
*E04F 15/02* (2006.01)

(52) U.S. Cl.
CPC ..... *E04F 15/02038* (2013.01)
USPC ..... 52/591.1; 52/582.1; 52/592.6

(58) Field of Classification Search
CPC ..... E04F 15/10; E04F 15/02; E01C 3/00
USPC ..... 52/177, 403.1, 582.1, 747.11, 591.4, 52/589.1, 592.6, 591.1
See application file for complete search history.

(56) References Cited

U.S. PATENT DOCUMENTS

| | | | | |
|---|---|---|---|---|
| 4,226,064 | A * | 10/1980 | Kraayenhof | 52/180 |
| 7,488,525 | B2 * | 2/2009 | Bird et al. | 428/44 |
| 8,424,257 | B2 * | 4/2013 | Jenkins et al. | 52/177 |
| 8,640,403 | B2 * | 2/2014 | Masanek et al. | 52/177 |
| 8,650,824 | B2 * | 2/2014 | DeLong et al. | 52/403.1 |
| 2005/0183370 | A1 * | 8/2005 | Cripps | 52/591.5 |

* cited by examiner

*Primary Examiner* — Jeanette E Chapman
*Assistant Examiner* — Daniel Kenny
(74) *Attorney, Agent, or Firm* — Dax D. Anderson; Kirton McConkie

(57) ABSTRACT

An impact attenuating tile system that can be selectively installed and uninstalled without damaging the modular tiles making up the system is disclosed. The system uses a support ladder to support the seam between two modular tiles. The seam can support wheelchairs and other heavy equipment positioned on the seam between two tiles without the tiles coming apart. Additionally, the tiles can be selectively removed without damaging or disfiguring the tiles. The system taught herein allows a user to implement a system which provides fall height attenuation, is ADA complaint, is not prone to creating tripping hazards even under high loads, and can be removed or replaced as deemed appropriate and can be selectively removed without cutting, disfiguring compromising the tiles.

20 Claims, 10 Drawing Sheets

SYSTEMS AND METHODS FOR SELECTIVELY RELEASABLE MODULAR TILE

BACKGROUND

Research has shown that, on average, more than 200,000 children are treated in U.S. hospital emergency rooms for playground-equipment-related injuries, many of which result from falls. To minimize the risks associated with playgrounds, a number of guidelines are established which require surfaces under the playgrounds to attenuate the impact of a fall.

While the primary function of a surface is often safety, the Americans' with Disabilities Act ("ADA") also requires playgrounds and indoor play areas be wheelchair accessible. Thus a surface must be soft enough to sufficiently attenuate the impact of a fall, while at the same time be firm, stable and slip resistant enough to comply with the ADA. Oftentimes, these two apparently conflicting requirements are reconciled by placing a solid access path to the playground structure. While such a path complies with ADA requirements, it also poses the risk that anyone falling onto the surface could result in serious injury or even death.

A combination of guidelines promulgated from both government and independent bodies tackle the tricky issue of providing surfaces at play areas that are soft enough to prevent most fall injuries but that are also firm and stable enough for wheelchair maneuvering. For example, the guidelines, based on American Society for Testing and Materials (ASTM) standards, state that wheelchair access surfaces are required to be "firm, stable and slip resistant" as specified in Americans with Disabilities Act Accessibility Guidelines (ADAAG). Another example is the amount of force required to rotate the caster wheels of a wheel chair as set forth in ASTM standard F-1951, which is based on a measurement of the physical effort to maneuver a wheelchair across a surface. Accessible surfaces within the use zone (the ground level area beneath and immediately adjacent to a play structure) are also required to be "impact attenuating" in compliance with ASTM F-1292 requirements for drop testing.

Materials currently used as impact-absorbing surfaces under playgrounds include sand and gravel, shredded tires, poured rubber and foam to name a few. Sand and gravel have been traditionally used outdoors because of their impact attenuation properties, wide availability and low cost. However, such a surface is not wheelchair accessible. In addition, sand and gravel tends to lump and harden when wet or frozen. In addition, the critical fall height for sand and gravel is merely nine feet, which is reduced to five feet when the sand or gravel is compressed. Furthermore, such a surface can cause abrasions when a playground patron falls, can cause a patron to trip when running, is tracked indoors and can cause scratches on floors, can be thrown, can be blown away with wind, as well as be an attraction for cats and other animals. Thus, sand and gravel are not ideal materials to use for playground purposes.

Alternatively, shredded tires are used, however, these pose additional problems of becoming very hot when in direct sunlight, being flammable, and containing steel belts that were part of the original tire. Additionally, shredded tire installations, when properly installed to attenuate falls, do not meet the requirements for accessibility as defined in ASTM F-1951.

Similarly, poured rubber is used because it is wheelchair accessible, however, it is expensive to purchase and install. In addition, as the rubber wears out under high traffic areas such as swings, the rubber cannot be replaced without significant additional expense. Furthermore, several obstacles arise during installation such as bonding the rubber to the cement base or ground and requiring completely level ground when the rubber is poured. Poured rubber is also prone to cracking and mechanical failure if exposed to ultraviolet light, extreme temperatures or water. There is evidence that, when exposed to environmental factors over time, a poured surface may deteriorate to the point where it will fail ASTM F-1292 testing.

Similarly, current impact attenuation mats are permanently bonded together with glue or other bonding agents which are not easily disassembled. Moreover, when the tiles are permanently bonded together the tiles must be disfigured, destroyed or otherwise compromised to be removed. This prevents installation of tile assemblies in non-permanent locations such as rented or leased spaces.

Given the known hazards and limitations of existing surfaces, an impact-attenuating surface, which is also firm, stable, and slip-resistant in accordance with the ADA, would be beneficial.

SUMMARY

Embodiments taught herein describe a selectively removable modular tile system comprising a lock and key locking member and a lip and channel coupling member. The system may be ADA compliant to allow wheelchairs to roll across the surface and be positioned on the joint or seam between two tiles without vertically displacing one from another tile. Moreover, heavy equipment, such as play structures and equipment can be placed on the tile surface at the joint or seam between two modular tiles and the tiles will not be vertically displaced. Additionally, tiles can be selectively removed if damaged, disfigured, or it is desired to relocate they system. Thus the system taught herein allows a user to implement a system which provides fall height attenuation, is ADA complaint, is not prone to creating tripping hazards even under high loads, and can be removed or replaced as desired.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF REPRESENTATIVE EMBODIMENTS

Figure 1:
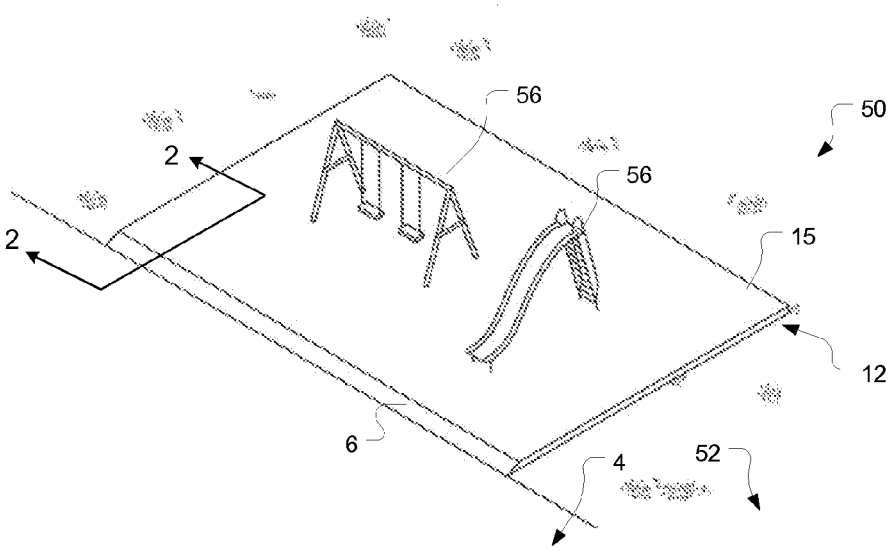
FIG. 1 illustrates a representative play area for children according to some embodiments of the invention.

This specification describes representative embodiments and applications of the invention. The invention, however, is not limited to these representative embodiments and applications or to the manner in which the representative embodiments and applications operate or are described herein. Moreover, the Figures may show simplified or partial views, and the dimensions of elements in the Figures may be exaggerated or otherwise not in proportion for clarity. In addition, as the terms "on," "attached to," or "coupled to" are used herein, one object (e.g., a material, a layer, a substrate, etc.) can be "on," "attached to," or "coupled to" another object regardless of whether the one object is directly on, attached, or coupled to the other object or there are one or more intervening objects between the one object and the other object. Also, directions (e.g., above, below, top, bottom, side, up, down, under, over, upper, lower, horizontal, vertical, "x," "y," "z," etc.), if provided, are relative and provided solely by way of example and for ease of illustration and discussion and not by way of limitation. In addition, where reference is made to a list of elements (e.g., elements a, b, c), such reference is intended to include any one of the listed elements by itself, any combination of less than all of the listed elements, and/or a combination of all of the listed elements.

As used herein, "substantially" means sufficient to work for the intended purpose. The term "ones" means at least one or more.

Although specific embodiments and applications of the invention have been described in this specification, these embodiments and applications are representative only, and many variations are possible.

This specification describes representative embodiments and applications of the invention. The invention, however, is not limited to these representative embodiments and applications or to the manner in which the representative embodiments and applications operate or are described herein.

The Head Injury Criterion ("HIC") is a measure of the severity of an impact and takes into account its duration as well as its intensity. The criterion is based on the results of research into the effects of impacts on the human head. HIC is defined by the following integral formula:

$$HIC = \left[ (t_2 - t_1) \left\{ \frac{1}{(t_2 - t_1)} \int_{t_1}^{t_2} a \cdot dt \right\}^{2.5} \right]_{max}$$

Where "t" is defined as time and "a" is defined as deceleration at time t.

G-max is the maximum deceleration experienced by the head (or headform) during an impact. It is a measure of the peak forces that are likely to be inflicted on the head as a result of the impact. It is measured in standard units of G, acceleration due to gravity −9.8 m/s/s.

Critical fall height is the minimum free fall height resulting from all test drops of an instrumented head onto a surface for which an HIC less than 1000 or a G-max value less than 200 is obtained. Thus, for example, if the instrument is dropped from a fall height of X feet onto a non-impact attenuating surface the force of the impact may be HIC of 1500 and a G-max of 210. Such force may lead to injury in a person. In contrast if the same instrument were then dropped from the same fall height onto an impact attenuating surface the HIC might be 500 and the G-max might be 100, and accordingly the probability of an injury resulting is much less.

FIG. 1 illustrates a representative play area 50 for children such as may be installed in indoor play areas and gyms. The play area 50 includes play equipment 56 (e.g., one or more swing sets, slides, climbing bars, etc.) and an impact attenuation system 12. As will be seen, impact attenuation system 12 is designed to absorb energy from an impact and thus protect children from falls from playground equipment 56, and impact attenuation system 12 may also be configured to have a sufficiently firm surface to allowed rolling equipment (e.g., a wheel chair, a baby stroller, etc.) to be pushed across the tarmac 15 of impact attenuation system 12. The representative area 50 shown in FIG. 1 is built on subsurface 4. A small ramp 6 is provided between subsurface 4 and tarmac 15.

Figure 2:
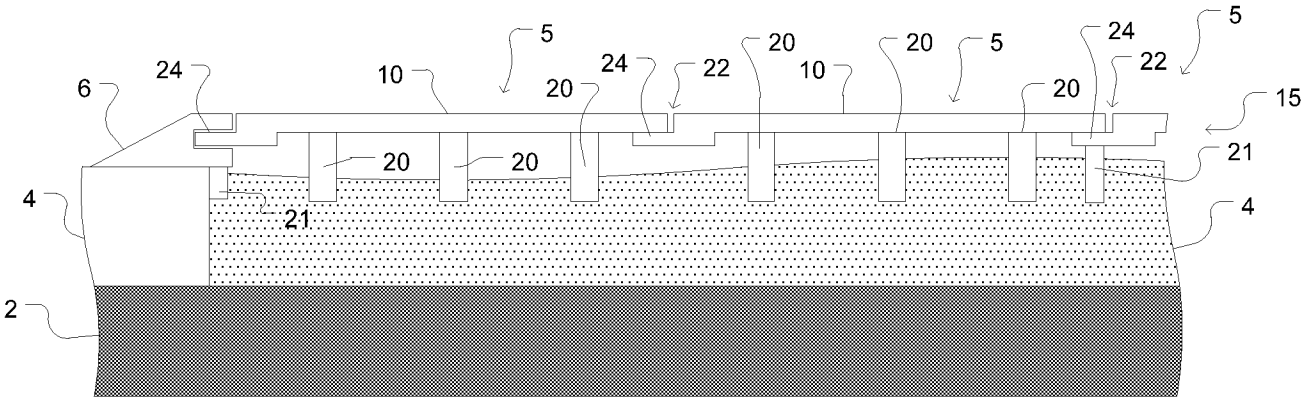
FIG. 2 illustrates a partial side, cross-sectional view of an impact attenuation system of the play area of FIG. 1.

FIG. 2 shows a partial side, cross sectional view of a representative configuration of impact attenuating system (see FIG. 1) according to some embodiments of the invention. As shown in FIG. 2, a mating structure comprises a first mat 5 overlapping a shelf extending from the bottom of the surface structure 10 of a second mat 5 so that the top surface of the surface structure 10 of the first mat and the top surface of the surface structure 10 of the second mat are approximately the same elevation across the seam 22 formed between the first mat and the second mat. A support leg 21 extends from the bottom of the shelf of the second mat 5 so to form a support base to the seam 22 formed between the first mat and the second mat. The support leg 21 is shorter than the other legs 20 by approximately the thickness of the surface structure 10 of the mat 5 so as to form a uniform plane between the support leg 21 and the legs 20 extending from the bottom of the mat 5. In certain embodiments a plurality of support legs 21 are positioned along the bottom of the shelf to support to the shelf to prevent the seam 22 from overflexing and causing two tiles to non-selectively separate. As shown in FIG. 2, each mat 5 includes a surface structure 10 and legs 20, which may rest on a subsurface 4 of fill material or may extend at least partially into fill material. Each mat 5 also includes a linking tab 24 that interlocks a mat 5 with an adjacent mat by sliding into slot 25 (see FIG. 6). A plurality of mats 5 can thus be interlocked to form tarmac 15 in just about any desired shape and size.

FIG. 2 also shows part of an asphalt area 4 and ramp 6, which may be formed of a plurality of sloped mats that interlock with a linking tab 24 of a mat 5 as shown. Ramp 6 provides a sloped ramp structure from the subsurface 4 to the tarmac 15.

Although fill material 14 is loose, allowing legs 20 to sink into the fill material 14, a landscape fabric (not shown) may be placed between fill material 14 and legs 20, preventing legs 20 from sinking into fill material 14. Such a landscape fabric (not shown) may additionally protect the fill material 14 from, for example, ultra violet light from the sun.

Because the representative tarmac 15 shown in FIG. 2 is modular, that is, formed of a plurality of interlocking mats 5, individual mats 5 may be replaced as specific areas wear out. This may occur under swings or other high traffic areas or through damage and vandalism. Similarly as particular mats 5 of the tarmac 15 are adversely affected by weather or ultraviolet degradation from exposure to sunlight, or have a mechanical failure such mats 5 can be replaced. The upper surface of the tarmac 15 may comprise an undulating surface to improve traction, and to provide flex, which will attenuate an impact. The undulating upper surface of the tarmac 15 may optionally comprise a plurality of small flexible arches, the elasticity of the arch being determined by the materials from which the tarmac 15 is made.

Mats 5 can be made from a number of different materials, including but not limited to, synthetic polymers such as PVC, as well as a variety of other polymers commonly known in the art. Furthermore, mats 5 can be formed in molds, using extrusion techniques, etc. An edging (e.g., comprising one or more ramps 6) can also be used to couple the tarmac 15 to another surface such as a cement or asphalt surface, or to reduce the amount of energy needed to get a wheelchair onto the tarmac 15 surface. The edge thus may be an extension from the tarmac 15 surface to another surface, or it may be tapered to provide a ramp from another surface up to the tarmac 15 surface (e.g., like ramp 6 shown in FIG. 2).

Extending from the bottom of each mat 5 are legs 20. Legs 20 may sit on top of the subsurface 4 such as a floor or even fill material which may work its way to fill the interstitial spaces between the legs 20. Legs 20 may be a variety of different lengths. If the legs 20 have different lengths, each leg 20 will make contact with the fill material 14 at different times and thus increase energy impact dissipation and attenuation of an impact of a fall. Furthermore, the legs 20 further improve the impact-attenuation properties of the energy absorption system by concentrating force onto certain areas, and allowing the tarmac 15 surface to flex. The mats may also be used to reduce erosion in high traffic areas, or to promote growth of vegetation in high traffic areas.

Mats 5 may be tethered to ground 2 to prevent the tarmac 15 from sliding off the fill material 14. In addition, the tethers (not shown) may help anchor the fill material 14 in a stationary position. Any tethering structure suitable for anchoring mats 5 to ground 2 may be used. For example, rigid steel spikes may be driven through mats 5 and into ground 2. As another example, mats 5 may be tied using string, wire or rope to spikes that are driven into ground 2 below tarmac 15.

Figure 3:
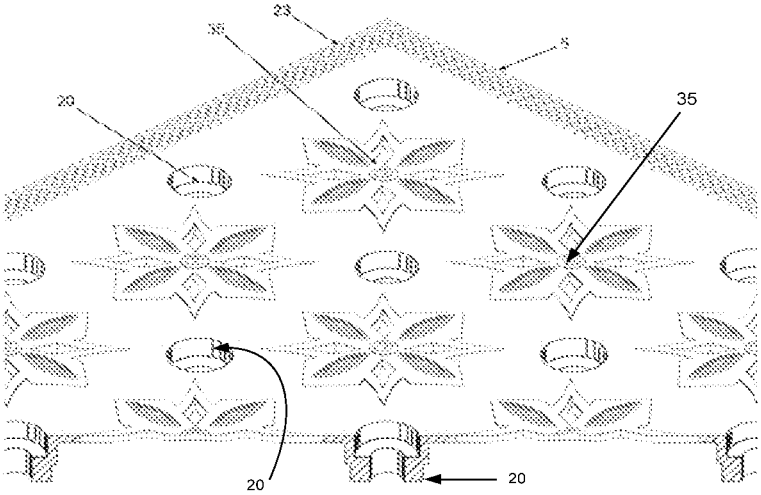
FIG. 3 illustrates a partial, top perspective view of a mat that may form a tarmac of the impact attenuation system of FIG. 2.
Figure 4:
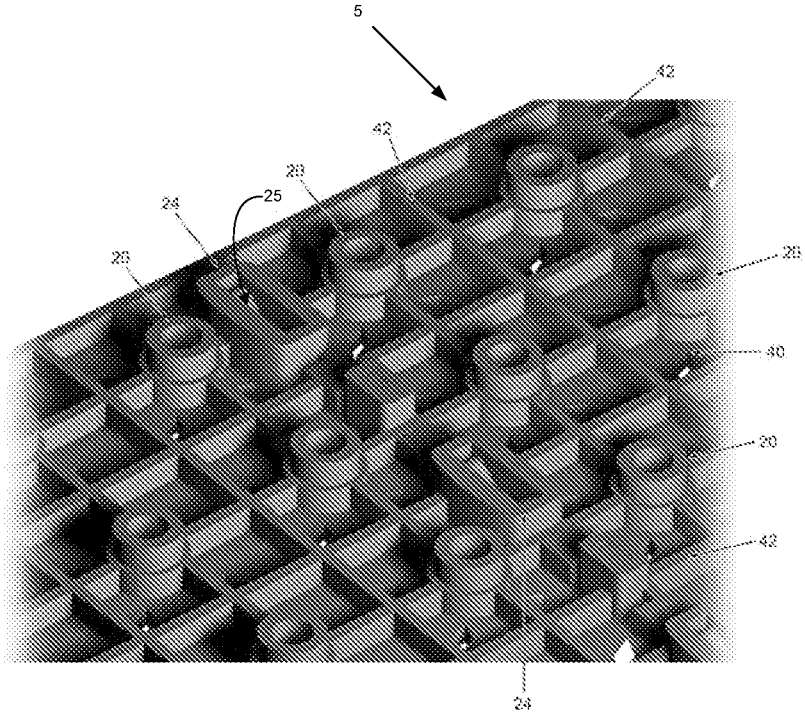
FIG. 4 illustrates a partial, bottom perspective view of two linked mats that may form the tarmac of the impact attenuation system FIG. 2.
Figure 5:
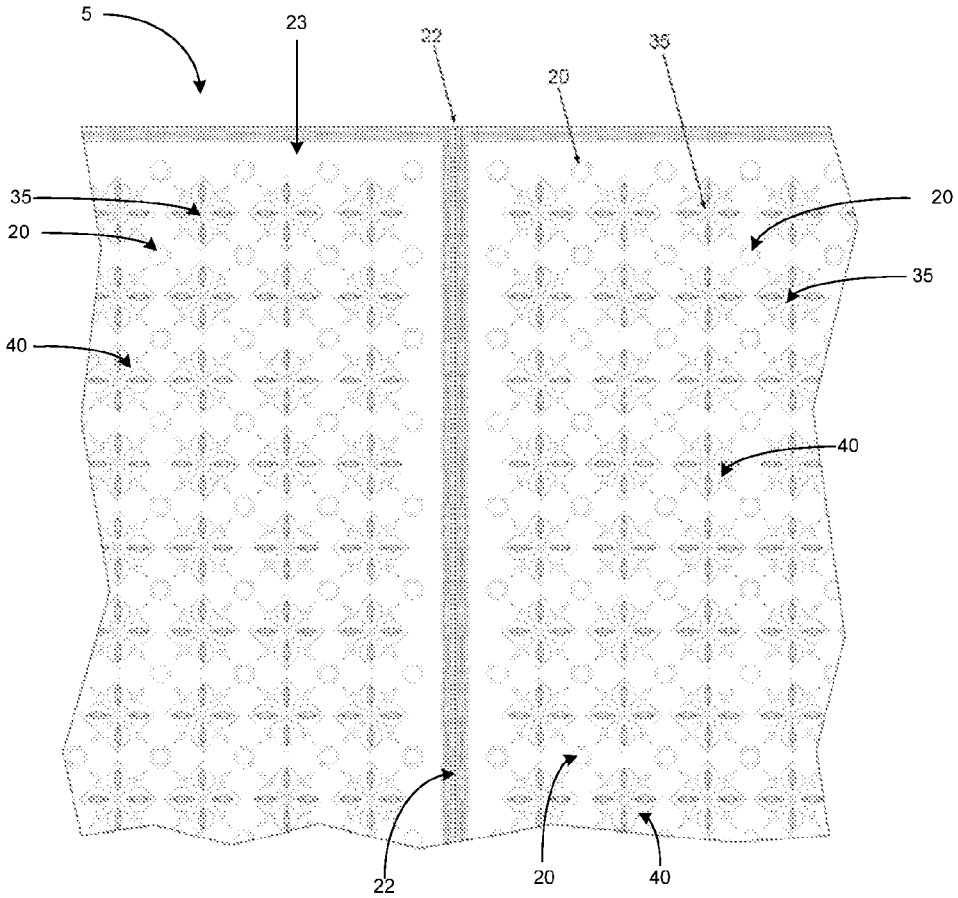
FIG. 5 illustrates a partial top view of two linked mats that may form the tarmac of the impact attenuation system FIG. 2.
Figure 6:
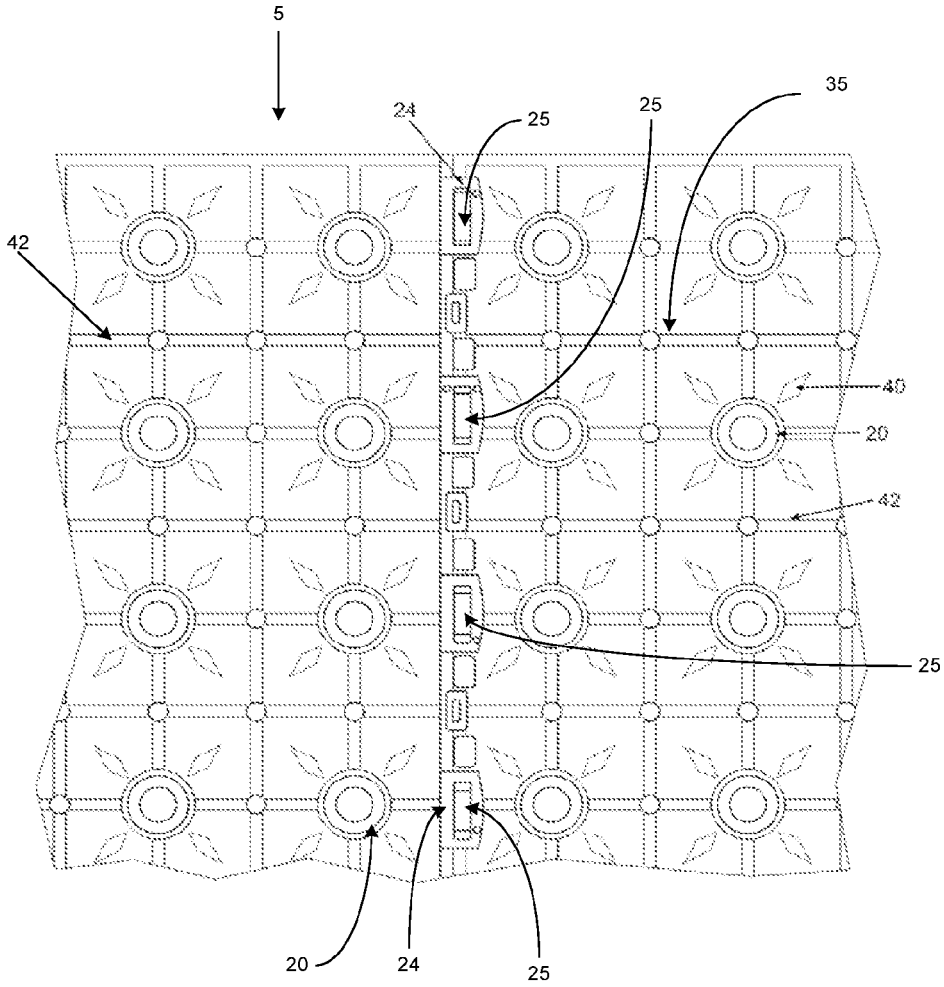
FIG. 6 illustrates a partial bottom view of two linked mats that may form the tarmac of the impact attenuation system FIG. 2.
Figure 8:
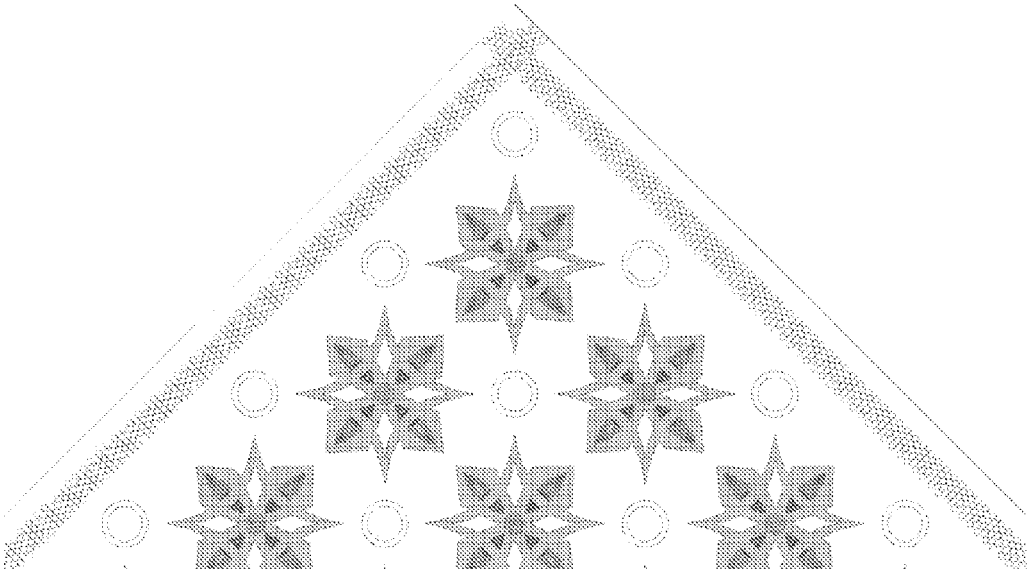
FIG. 8 illustrates a representative embodiment of a mat.

FIGS. 3-6 and 8 illustrate a representative mat 5 or mats 5 that may be used to form the tarmac 15 covering over fill material 14 or subsurface 2. FIG. 3 and FIG. 8 illustrate a partial, top perspective view of a mat 5; FIG. 4 illustrates a partial, bottom perspective view of two interlocked mats, each like the mat shown in FIG. 3; and FIGS. 5 and 6 show top and bottom views, respectively, of two interlocked mats 5 each like the mat 5 shown in FIG. 3.

The representative mats 5 shown in FIGS. 3-6 comprise a relatively thin surface structure 23 supported by a grid structure comprising an array of legs 20 that are connected one with another by rib structures 42. As also shown, surface structure 23 includes a plurality of arches 35 each located generally between four legs 20 and four rib structures 42.

The representative embodiments teach at least three impact attenuation techniques which may be used either separately or in combination with each other. The mat 5 structure illustrated in FIGS. 3-6 absorbs the impact of a child's fall in several ways. First, arches 35 are flexible and absorb or attenuate at least some of the force from a child's fall. Second, the rib-grid structure (formed by legs 20 and rib structures 42) allows the mat 5 to flex horizontally with respect to the top surface of the mat 5. The rib-grid thus dissipates some of the force from the child's fall horizontally through mat 5. Third, the mat 5 transfers some of the energy from the child's fall through legs 20 to subsurface 14, which as discussed above, itself is soft and readily absorbs at least part of the energy from the child's fall.

As a result, when a child falls onto the tarmac 15, three separate energy attenuating features aid in reducing the adverse effects of such a fall. First the impact causes the arches 35 to flex, absorbing energy. Second the entire tarmac 15 flexes horizontally dissipating some of the impact from the child's fall horizontally (e.g., generally level with ground 2). Third, the fill material 14 absorbs some of the force from the child's impact with the tarmac 15.

The amount of flex in the arches 35 depends on the radius of curvature in the arch, the height of the arch, as well as the material from which the mat 5 is made. The amount of flex provided by the grid structure depends on several factors, including the materials that form the legs 20 and rib structures 42, and the size, spacing, and number of legs 20 and the size and thickness of the rib structures 42.

The arches 35 of mats 5 form an undulating pattern on the outer surface of the tarmac 15, which may improve the tarmac 15's traction by allowing increased surface contact between a patron's foot or shoe and the tarmac 15. In addition, there are a number of pores 40 formed in a mat 5, which allow water to drain through mats 5. A seam 22 between two adjacent mats 5 also provides improved flex upon impact by spreading under a force, as well as the convenience of replacing the surface in a particular area for low cost and as needed.

Figure 9:
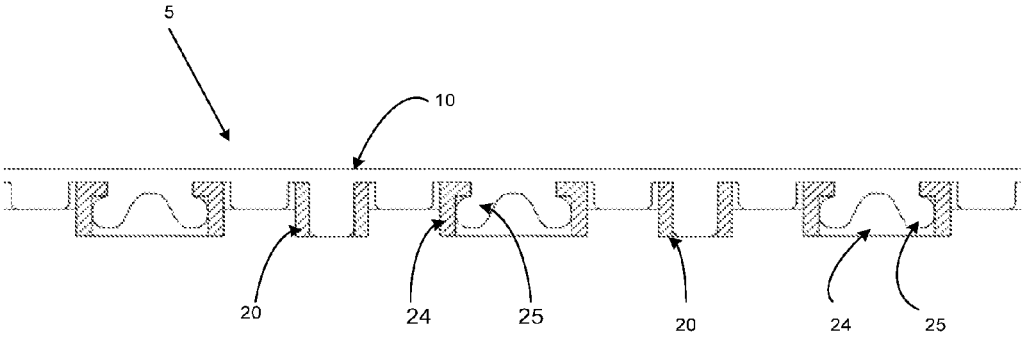
FIG. 9 illustrates a representative cut-away view of a mat having a plurality of tabs and slots fit together.

As best seen in FIG. 6, which shows the bottom side of two interlinked mats 5, linking tabs 24 couple adjacent mats 5 by sliding into slot 25 (see FIG. 9). Tab 24 is designed to provide a secure link and may also be designed to flex to absorb energy from an impact, such as a falling child. In addition to the linking tabs 24, the mats 5 are secured using both an adhesive such as glue and a heat source where two adjacent mats 5 are configured to overlap. In such a case the mats 5 are bonded together using both an adhesive and a heat source to melt the contacting plastic and further improve the bond. For example, the linking tab 24 may be coupled to an adjacent mat, a heat gun may be used to melt and fuse the tab to the adjacent surfaces, an adhesive such as glue may then be used to bond the two adjacent mat surfaces. Of course the heat treatment can only be used on thermoplastics such as PVC.

The combination of an impact attenuation fill material 14 and an impact attenuation tarmac 15 overlaying the fill material 14 has been found to provide greater impact attenuation than the sum of the impact attenuation of the fill material 14 by itself and the impact attenuation of the tarmac 15 by itself. That is, the impact attenuating system of FIG. 2 absorbs more energy from an impact—and thus provides greater protection to a failing child—than the sum of the energy absorbed by the fill material 14 alone and the tarmac 15 alone. This unexpected, synergistic increase in the impact attenuation properties of the combination of tarmac 15 overlaying fill material 14 is believed to be due to the multiple ways in which the system absorbs energy from an impact.

As discussed above, the impact attenuation system disclosed herein attenuates an impact in three ways. First, referring to the mat 5 depicted in FIGS. 3-6, the arches 35 deform generally vertically with respect to the top surface of surface structure 10 (which is generally in the direction of the impact force) and thereby attenuate energy from an impact. Second, as discussed above, the grid structure comprising the array of legs 20 and interconnecting rib structures 42 allows mats 5 to flex generally horizontally with respect to the top surface of surface structure 10 and thereby attenuate energy from an impact. Third, as also discussed above, energy from the impact is transferred through legs 20 to fill material 14, which also attenuates energy from the impact. The energy from the impact is attenuated by the fill material 14 as individual pieces of fill material 14 move closer together and flex under the force of the impact.

The performance of the representative system can meet the gmax<200 and Head Impact Criterion<1000 requirements from a critical fall height of 12 feet.

In addition to absorbing energy from an impact (e.g., a falling child), the grid structure comprising the array of legs 20 and interconnecting rib structures provides mats 5 with a sufficiently firm surface to allow rolling equipment to be used on tarmac 15. Generally speaking, the less a wheel sinks into a surface, the less effort and energy is required to roll the wheel across the surface and to turn the wheel on the surface. As one example, the grid structure formed by legs 20 and interconnecting rib structures 42 may be configured to provide tarmac 15 with a sufficiently firm surface for a baby stroller to be pushed on the tarmac 15 surface and the wheels turned on the tarmac 15 surface by a typical adult without requiring an uncomfortable effort from the adult. As another example, the grid structure formed by legs 20 and interconnecting rib structures 42 may be configured to provide tarmac 15 with a sufficiently firm surface to meet ADA standards for use of a wheelchair on the surface of tarmac 15.

Thus, as discussed above, the tarmac 15 shown in FIG. 2 is able to meet both the impact attenuation requirements for protecting a child from a fall of the ASTM guidelines and the ADA requirements for wheelchair accessibility. That is, the combination of tarmac 15 and fill material 14 is sufficiently impact absorbing to protect a child from a fall while at the same time provide a sufficiently firm surface to allow the use of a wheelchair on the tarmac 15.

Figure 7:
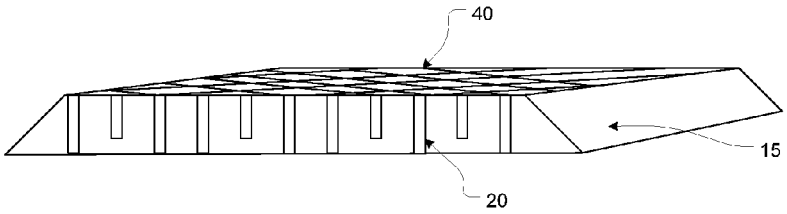
FIG. 7 illustrates a representative tarmac.

Referring now to FIG. 7, there is illustrated a representative embodiment of the present invention, wherein a tarmac 15 having legs 20 is used in a wet environment. Thus, the pores 40 allow water to leave the surface of the tarmac 15 and drain to the ground below. As discussed above, legs 20 may have a variety of different lengths and thus increase the impact attenuating properties of the tarmac 15.

Referring now to FIG. 9, a representative embodiment of a cut-away view of the seam 22 connecting two adjacent mats 5 is illustrated. In this representative embodiment a plurality of tabs 24 from a first mat 5 are fit into a plurality of receiving slots 25 to secure the two mats. Additionally glue and/or a thermal bond may be formed between the mats so as to further strengthen the couple holding the mats 5 together.

Certain representative embodiments of the selectively releasable modular tile system may comprise features that allow the system to be selectively uninstalled. This is accomplished through the use of selectively releasable structure which permits the tiles to be selectively installed on a temporary basis and to be uninstalled without damaging the tiles. Indeed the same tiles which have been uninstalled may be again installed without any modification or repair, thus making the tiles a solution for nearly any environment.

Alternative representative embodiments of the tile system may be selectively installed and also selectively uninstalled without damaging the tiles. This ability to selectively install and selectively uninstall the tiles allows the tiles to be used in more diverse environments including temporary properties such as rental properties in strip malls, military tents and other environments. Often a tile system requires a significant capital investment. Accordingly, their use is limited to environments where the system will be utilized long term to justify the expense or to allow an owner to recoup the investment made in the tile system. In the past this limitation has excluded use of tile systems from transient or temporary environments in favor of more predictable environments because previous tile systems were installed using permanent techniques which could only be uninstalled by damaging a tile to remove it.

Alternative representative embodiments comprise selectively removable or unistallable tiles such that it can be installed on a temporary basis and uninstalled when an owner wants to remove it, ADA compliant tile systems that meets fall height requirements, ADA requirements and that will remain coupled under direct force of greater than approximately 3 pounds per square inch when the force is exerted directly above a seam 22 between two different tile members. The ability to remain coupled under this force allows equipment such as play structures weighing up to 300 pounds to be placed on the tile system without forcing the tiles to separate and create a tripping hazard.

Figure 10A:
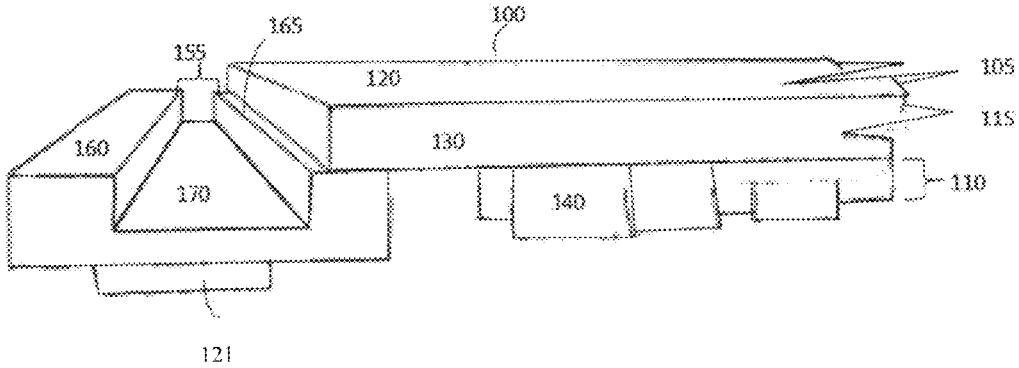
FIG. 10 A illustrates a perspective view of the tile featuring the channel.
FIG. 10B illustrates a perspective view of the tile featuring the channel with a coupling member.

Certain exemplary embodiments comprise a ladder system as shown in FIG. 10A which allows the system to remain coupled when a downward force is placed on the seam 22. The ladder structure comprises first support surface 160, second support surface 165, the walls of the trough or recess 170 and the recess leg 121. These structural features support a seam 22 between two separate tiles and prevent the seam 22 from over-flexing. The first and second support surfaces 160 and 165 support a lip 130 of a tile that is selectively placed over the recess 170. When a force is placed on the seam 22 the support surfaces 160, 165 transfer the force from the walls of the recess 170 which then passes the weight to the leg 121. The length of recess leg 121 is such that it the end of the recess leg 121 is coplanar to the other legs 140 extending from the bottom of the tile. In certain embodiments, as the force at the seam 22 increase, the strength of the coupling increases because any deformation along the seam 22 is accommodated by the coupling of the coupling members. In certain embodiments a plurality of recess legs 121 are positioned along the bottom of the recess 170 to provide support to the recess to prevent the recess from overflexing and causing two tiles to non-selectively separate.

Figure 10B:
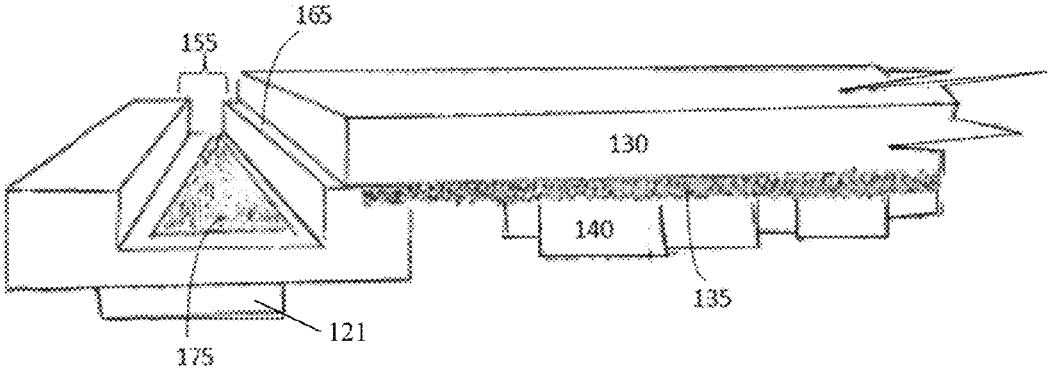
Figure 11A:
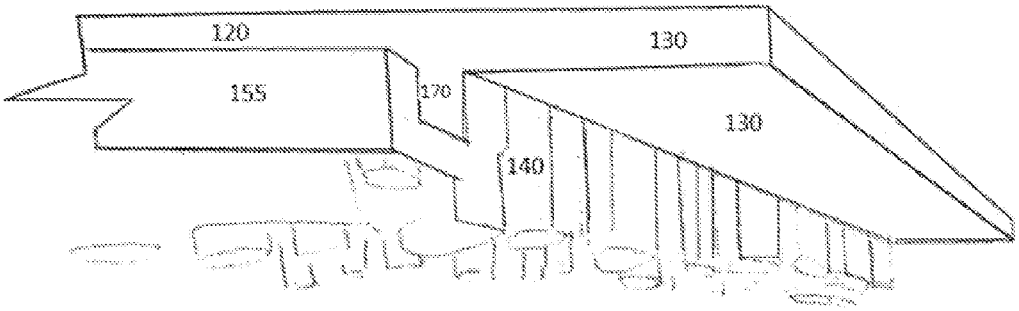
FIG. 11A illustrates a perspective view of the tile featuring the lip.
Figure 11B:
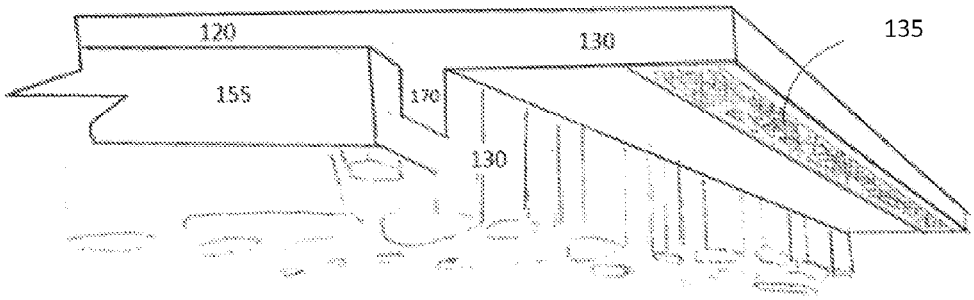
FIG. 11B illustrates a perspective view of the tile featuring the lip with a coupling member.
Figure 12:
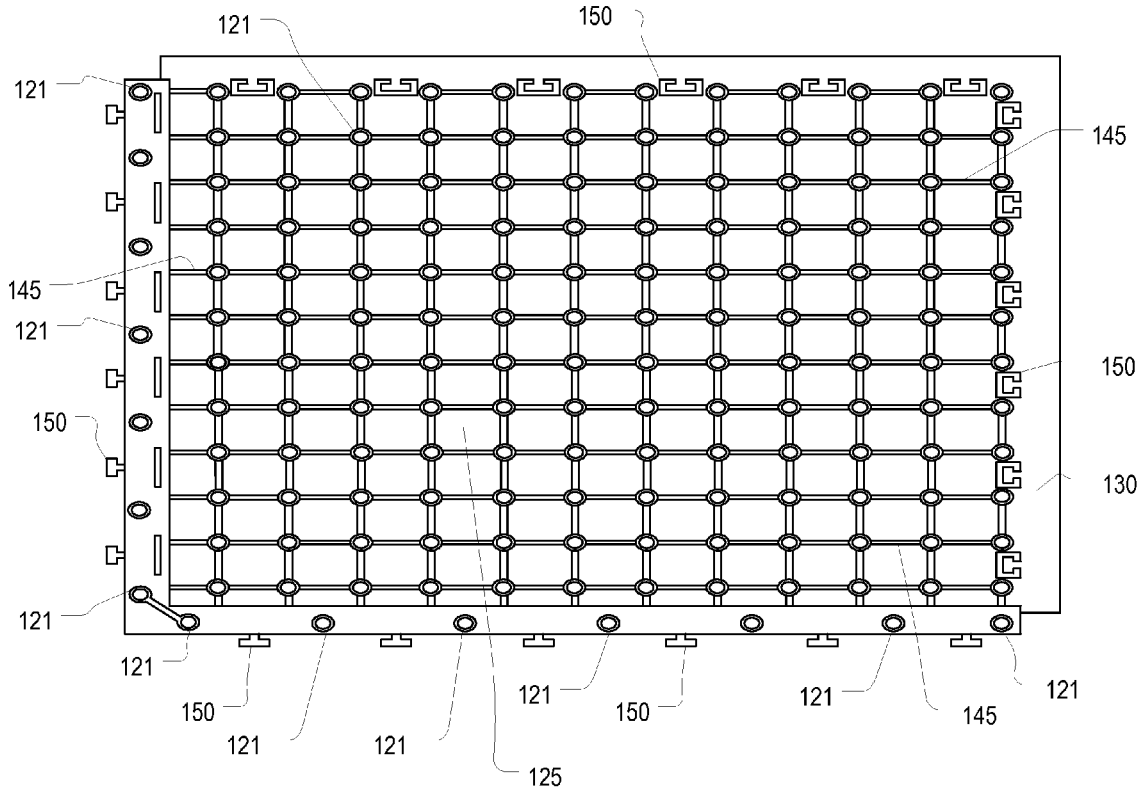
FIG. 12 illustrates a plan view of the tile from the bottom view.

Referring now to FIGS. 10-12, representative embodiments of a selectively releasable and selectively installable modular tile comprise an integral modular tile 100 comprising an upper portion 105 and a lower portion 110 divided by a dividing plane 115. The structure of the upper portion 105 is above the dividing plane and the structure of the lower portion is below the dividing plane. In certain embodiments the upper portion is a square, however it may be another geometric shape such as a triangle, trapezoid or other shapes that can be pieced together to form a modular floor covering system that covers an area.

In a representative embodiment the tile 100 has a thickness of approximately 1.5 cm. The upper portion 105 has a substantially uniform thickness of approximately 0.5 cm. The lower portion 110 is comprised of different structures, discussed below, which comprise various thicknesses. The tile's thickness, including the thickness of the upper portion 105 and the lower portion 110 may be thinner or thicker than 1.5 cm depending on the desired characteristics of the tile 100. The tile 100 may be formed from polymeric material, plastics or a composite of plastics and other materials including textiles or recycled materials. Furthermore, the tile may be formed by injection molding, rotational molding or stamping.

The upper portion 105 comprises a top surface 120 and a bottom surface 125. At least one distal edge of the top portion comprises a lip 130. The thickness of the lip may be the same thickness as the thickness of the upper portion 105. The lip 130 further comprises a first coupling member 135 bonded to the surface of the lip with an adhesive or mechanically coupled to the lip 130. Alternatively the first coupling member 135 may be integrated into the lip 130. The lip 130 is disposed above the dividing plane 115; however, the first coupling member may extend below the dividing plane.

The lower portion 110 comprises structures integrated into the upper portions 105. These structures comprise legs 140 ribs 145, locking members 150, and at least one channel 155. The legs 140 are disposed below the dividing plane and spaced so as to create a structural void between the bottom surface 125 of the upper portion 105 and the bottom plane of the lower portion 110 formed by the distal ends of the structures forming the lower portion. The bottom plane of the lower portion rests on a substrate, such as a rubber mat, foam mat, or other impact attenuating substrates upon which the lower portion may be placed. The structures of the lower portion may be welded, sonically welded, laser welded or connected by other techniques.

The ribs 145 are disposed along the bottom surface 125 of the upper portion and span from one leg to another with the leg being disposed at a rib intersection.

Locking members 150 are disposed along at least one distal edge of the tile 100. The locking member 150 comprises a lock and key mechanism to selectively and securely link two modular tiles together. The locking members 150 are linked by aligning the key and the lock vertically and sliding the key into the lock. The lock and key mechanism keep the modular tiles uniformly spaced.

The channel 155 is a second linking mechanism that selectively and securely couples two modular tiles together. The channel comprises a first support surface 160 and a second support surface 165 with a recess 170 formed between the first support surface and the second support surface. An embodiment teaches the horizontal surface area of the first support surface 160 is greater than the horizontal surface area of the second support surface 165. In alternative embodiments, the horizontal surface area of the first support surface 160 is less than the horizontal surface area of the second support surface 165. Both of these configurations will support a lip 130 of another tile to create a secure seam 22 between the first and second tile. The first support surface and the second support surface are coplanar with each other and with the dividing plane. The channel further comprises a second coupling member 175 disposed in the recess. The second coupling member 175 may be bonded to the tile in the recess 170 with an adhesive, integrated into the recess, or with mechanical means. The second coupling member is complimentary to the first coupling member and can selectively couple with the first coupling member.

The lip 130 and channel 155 are complimentary structures and allow two modular tiles 100 to selectively couple. In practice two tiles may be coupled using the lock and key of the locking mechanism 150 described above which will align the lip and the channel. The first coupling member 135 is placed into the recess 170 so the first couple member mates 135 with the second coupling member 175. When aligned the lip 130 rests on the first support surface 160 and the second support surface 165 so the bottom surface of the upper portion of the first tile and the bottom surface of the second tile are coplanar. With alignment the joint formed between the first and second tiles will not create a tipping hazard. Moreover, using Dual Lock™ from 3M® to couple the tiles together creates sufficient strength so as to prevent a vertical force of 300 pounds per unit area from displacing the coupled tiles which could result in a tripping hazard.

The structure described herein presents several advantages including being ADA compliant. Heavy wheelchairs positioned on the joint or seam 22 between two tiles, will not cause one tile to vertically displace from another tile. Moreover, heavy play structures and equipment can be placed on the tile surface at the joint or seam 22 between two modular tiles and the tiles will not be vertically displaced. Additionally, the tiles can be removed if damaged or disfigured. Thus the system taught herein allows a user to implement a system which provides fall height attenuation, is ADA complaint, is not prone to creating tripping hazards even under high loads, and can be removed or replaced as deemed appropriate.

The embodiments disclosed herein are provided by way of example only and are non-limiting examples.

What is claimed:

1. A modular tile comprising:

an upper portion forming an upper surface and a lower surface;

a channel that extends along a first edge of the upper portion, the channel having an upper surface and a lower surface, the upper surface of the channel comprising a first support surface and a recess dividing the first support surface from the upper portion such that the first support surface and the recess are positioned beyond the first edge, the recess including a fastening material;

the upper portion including a corresponding fastening material that is positioned on the lower surface along a second edge, the second edge being opposite to the first edge such that, when a second edge of a first modular tile is placed against a first edge of a second modular tile with the lower surface of the second edge resting on the first support surface of the second modular tile, the corresponding fastening material positioned along the second edge of the first modular tile inserts within the recess of the second modular tile to interlock with the fastening material in the recess thereby preventing the first modular tile from separating from the second modular tile.

2. The modular tile of claim 1, wherein the first support surface comprises a plurality of locking mechanisms that extend outwardly from the first support surface, and the lower surface of the upper portion includes a corresponding plurality of locking mechanisms positioned along the second edge such that when the second edge of the first modular tile is placed against the first edge of the second modular tile, the plurality of locking mechanisms interlock with the corresponding plurality of locking mechanisms.

3. The modular tile of claim 2, wherein the plurality of locking mechanism insert within the corresponding plurality of locking mechanisms.

4. The modular tile of claim 1, further comprising:

a second channel that extends along a third edge of the upper portion, the second channel having an upper surface and a lower surface, the upper surface of the second channel comprising a first support surface and a recess dividing the first support surface from the upper portion such that the first support surface and the recess of the second channel are positioned beyond the third edge, the recess including a fastening material;

the upper portion including a corresponding fastening material that is positioned on the lower surface along a fourth edge, the fourth edge being opposite to the third edge.

5. The modular tile of claim 4, wherein the first support surface of the second channel comprises a plurality of locking mechanisms that extend outwardly from the first support surface of the second channel, and the lower surface of the upper portion includes a corresponding plurality of locking mechanisms positioned along the fourth edge.

6. The modular tile of claim 1, wherein the lower surface of the upper portion includes a plurality of legs.

7. The modular tile of claim 6, wherein the lower surface of the upper portion includes a plurality of ribs that interconnect the plurality of legs.

8. The modular tile of claim 1, wherein the lower surface of the channel includes a plurality of legs.

9. The modular tile of claim 1, wherein the channel further includes a second support surface, the second support surface being connected to the lower surface of the upper portion, the recess dividing the first support surface from the second support surface.

10. A modular tile system comprising:

a first modular tile comprising:

an upper portion forming an upper surface and a lower surface;

a channel that extends along a first edge of the upper portion, the channel having an upper surface and a lower surface, the upper surface of the channel comprising a first support surface and a recess dividing the first support surface from the upper portion such that the first support surface and the recess are positioned beyond the first edge, the recess including a fastening material; and a second modular tile comprising:

an upper portion forming an upper surface and a lower surface;

a fastening material that is positioned on the lower surface along a second edge, such that, when the second edge of the second modular tile is placed against the first edge of the first modular tile with the lower surface of the second edge resting on the first support surface of the second modular tile, the fastening material of the second modular tile inserts within the recess of the first modular tile to interlock with the fastening material in the recess thereby preventing the first modular tile from separating from the second modular tile.

11. The modular tile system of claim 10, wherein the first support surface comprises a plurality of locking mechanisms that extend outwardly from the first support surface, and the lower surface of the upper portion of the second modular tile includes a corresponding plurality of locking mechanisms positioned along the second edge such that when the second edge of the second modular tile is placed against the first edge of the first modular tile, the plurality of locking mechanisms interlock with the corresponding plurality of locking mechanisms.

12. The modular tile system of claim 10, wherein the lower surface of the upper portion of the first modular tile includes a plurality of legs.

13. The modular tile system of claim 10, wherein the lower surface of the channel includes a plurality of legs.

14. The modular tile system of claim 10, wherein the channel further includes a second support surface, the second support surface being connected to the lower surface of the upper portion, the recess dividing the first support surface from the second support surface.

15. A modular tile comprising:

an upper portion forming an upper surface and a lower surface, the upper portion having a first edge, a second edge opposite the first edge, a third edge, and a fourth edge opposite the third edge;

a channel that extends along the first edge, the channel having an upper surface and a lower surface, the upper surface of the channel comprising a first support surface and a recess dividing the first support surface from the upper portion such that the first support surface and the recess are positioned beyond the first edge, the recess including a first fastening material;

a second fastening material that is positioned on the lower surface along the second edge;

a second channel that extends along the third edge, the second channel having an upper surface and a lower surface, the upper surface of the second channel comprising a first support surface and a recess dividing the first support surface from the upper portion such that the first support surface and the recess of the second channel are positioned beyond the third edge, the recess of the second channel including a third fastening material; and a fourth fastening material that is positioned on the lower surface along the fourth edge.

16. The modular tile of claim 15, wherein the second edge of the modular tile is configured to interlock with a first edge of a second modular tile when the fastening material along the second edge inserts within a recess along the first edge of the second modular tile.

17. The modular tile of claim 15, wherein the first support surface of the channel comprises a plurality of locking mechanisms that extend outwardly from the first support surface of the channel.

18. The modular tile of claim 17, wherein the first support surface of the second channel comprises a second plurality of locking mechanisms that extend outwardly from the first support surface of the second channel.

19. The modular tile of claim 15, wherein the lower surface of the upper portion includes a plurality of locking mechanisms positioned along the second edge.

20. The modular tile of claim 19, wherein the lower surface of the upper portion includes a second plurality of locking mechanisms positioned along the fourth edge.

* * * * *